US008341922B2

(12) United States Patent
Anatrini

(10) Patent No.: US 8,341,922 B2
(45) Date of Patent: Jan. 1, 2013

(54) MACHINE FOR FILLING VIALS

(75) Inventor: Dario Anatrini, Siena (IT)

(73) Assignee: CO.RI.M.A. S.r.l., Monteriggioni (Siena) (IT)

( * ) Notice: Subject to any disclaimer, the term of this patent is extended or adjusted under 35 U.S.C. 154(b) by 561 days.

(21) Appl. No.: 12/571,533

(22) Filed: Oct. 1, 2009

(65) Prior Publication Data

US 2010/0096042 A1 Apr. 22, 2010

(30) Foreign Application Priority Data

Oct. 17, 2008 (IT) ..... BO2008A0642

(51) Int. Cl.
*B65B 31/02* (2006.01)
*B65B 61/28* (2006.01)

(52) U.S. Cl. ..... 53/79; 53/284.5; 53/284.6; 53/540

(58) Field of Classification Search ..... 53/79, 103, 53/284.6, 510, 281, 282, 167, 284.5
See application file for complete search history.

(56) References Cited

U.S. PATENT DOCUMENTS 3,939,626 A * 2/1976 Cioni et al. ..... 53/167
3,940,909 A * 3/1976 Cioni et al. ..... 53/167
3,964,238 A * 6/1976 Bippus et al. ..... 53/167
4,296,068 A * 10/1981 Hoshino ..... 422/62
4,349,053 A * 9/1982 Eisenberg ..... 141/1
4,375,145 A * 3/1983 Mosse et al. ..... 53/425
4,590,734 A * 5/1986 Ueda ..... 53/52
4,707,334 A * 11/1987 Gerhard ..... 422/28
4,867,315 A * 9/1989 Baldwin ..... 206/558
4,960,156 A * 10/1990 Tribert ..... 141/1
4,992,247 A * 2/1991 Foti ..... 422/304
5,016,688 A * 5/1991 Suzuki et al. ..... 141/170
5,152,968 A * 10/1992 Foti et al. ..... 422/304
5,299,408 A * 4/1994 Dupont ..... 53/432
5,519,984 A * 5/1996 Beussink et al. ..... 53/489

(Continued)

FOREIGN PATENT DOCUMENTS

DE 10246061 A1 4/2004

(Continued)

OTHER PUBLICATIONS

European Search Report.

*Primary Examiner* — Hemant M Desai
*Assistant Examiner* — Gloria R Weeks
(74) *Attorney, Agent, or Firm* — William J. Sapone; Coleman Sudol Sapone P.C.

(57) ABSTRACT

The machine, either in a version for open vials or in one for closed vials, has a cantilevered architecture such that at the sides of the relative conveyor line of the vials there is a substantially vertical air passage gap developing in a downwards direction and connected with a conveyor which opens into an air outlet facing externally of the machine and positioned considerably below the conveyor line. The operating organs of the machine, among which the conveyor line, are inserted in a chamber having a controlled atmosphere, to which means for forced ventilation are associated, which means generate a laminar flow of air directed from above in a downwards direction. The part of the laminar flow, which strikes the sides of the conveyor line and the vials present therein, enters, without perturbation, the air passage gap and exits from the air outlet; thus entry of polluting particles into the inlet of the vials is prevented.

6 Claims, 12 Drawing Sheets

U.S. PATENT DOCUMENTS

| | | | | |
|---|---|---|---|---|
| 5,525,295 | A * | 6/1996 | Pflug et al. | 422/27 |
| 5,609,819 | A * | 3/1997 | Shimizu et al. | 422/3 |
| 5,623,810 | A * | 4/1997 | Dey et al. | 53/425 |
| 5,673,535 | A * | 10/1997 | Jagger | 53/282 |
| 5,759,218 | A * | 6/1998 | Martin et al. | 55/385.1 |
| 5,842,321 | A * | 12/1998 | Jones | 53/281 |
| 5,865,010 | A * | 2/1999 | Sundby et al. | 53/167 |
| 5,884,457 | A * | 3/1999 | Ortiz et al. | 53/468 |
| 5,896,727 | A * | 4/1999 | Egli et al. | 53/426 |
| 5,961,000 | A * | 10/1999 | Sanfilippo et al. | 222/152 |
| 5,964,043 | A * | 10/1999 | Oughton et al. | 34/92 |
| 6,012,265 | A * | 1/2000 | Ady | 53/103 |
| 6,120,730 | A * | 9/2000 | Palaniappan et al. | 422/28 |
| 6,164,044 | A * | 12/2000 | Porfano et al. | 53/471 |
| 6,185,910 | B1 * | 2/2001 | Achhammer | 53/426 |
| 6,209,591 | B1 * | 4/2001 | Taggart | 141/89 |
| RE37,471 | E * | 12/2001 | Jagger | 53/282 |
| 6,457,299 | B1 * | 10/2002 | Schwenke et al. | 53/510 |
| 6,484,479 | B1 * | 11/2002 | Minion | 53/565 |
| 6,718,732 | B1 * | 4/2004 | Kovara et al. | 53/313 |
| 6,735,926 | B1 * | 5/2004 | Louviere | 53/467 |
| 6,792,743 | B2 * | 9/2004 | Odell et al. | 53/452 |
| 6,820,660 | B1 * | 11/2004 | Ludwig | 141/89 |
| 6,986,234 | B2 * | 1/2006 | Liedtke | 53/399 |
| 7,007,443 | B2 * | 3/2006 | Liedtke et al. | 53/399 |
| 7,685,796 | B2 * | 3/2010 | Capelli et al. | 53/510 |
| 7,726,352 | B2 * | 6/2010 | Py et al. | 141/11 |
| 7,832,078 | B2 * | 11/2010 | Thilly et al. | 29/527.1 |
| 7,905,257 | B2 * | 3/2011 | Py | 141/11 |
| 7,937,907 | B2 * | 5/2011 | Fleckenstein et al. | 53/268 |
| 8,037,659 | B2 * | 10/2011 | Osborne et al. | 53/53 |
| 2009/0094940 | A1 * | 4/2009 | Py | 53/267 |
| 2010/0050574 | A1 * | 3/2010 | Cedrone | 53/471 |
| 2011/0005168 | A1 * | 1/2011 | Liu et al. | 53/268 |
| 2011/0072759 | A1 * | 3/2011 | Mielnik et al. | 53/167 |
| 2011/0302884 | A1 * | 12/2011 | Monti | 53/281 |

FOREIGN PATENT DOCUMENTS

| | | | |
|---|---|---|---|
| EP | 1197430 | A | 4/2002 |
| EP | 1834878 | A | 9/2007 |
| EP | 1854748 | A | 11/2007 |
| WO | W02005/087592 | A | 9/2005 |

* cited by examiner

MACHINE FOR FILLING VIALS

BACKGROUND OF THE INVENTION

The invention relates to the technical sector of automatic machines for filling glass vials with liquid solutions, and for sealing them. The vials are of a type in which the successive opening is achieved by breaking a predetermined upper portion thereof.

The liquid solutions can be of various types, for example food, pharmaceutical, cosmetic or other types besides.

Empty vials are available in two configurations, respectively with the upper head open or closed.

In machines which use open vials, upstream of the filling station there must be a sterilization station in which the inside of the vials is made hygienic such as to be ready to receive the liquid product.

In machines which use pre-sterilized closed vials, upstream of the filling station an opening station has to be provided in which the top is opened to enable the liquid product to be inserted; the opening of pre-sterilized vials is obtained by melting the tops by means of flame means.

The sealing of the vials, after filling, follows the action of the heat, provided by suitable flame means, in combination with gripping means of the top of the vial and with a rotation of the vials themselves. This stage is performed identically for both types of vials indicated above.

Normally vials are constructed by specialized producers and supplied to the above-cited industries. By using open vials, the whole process, from hygienic treatment to sealing, is under the direct control of the producer of the final product, while with pre-sterilized closed vials the certification given by the producer of empty vials has to be accepted in order to provide certification on the finished product.

To prevent contamination by polluting agents of the products and the vials, before closing them it is obvious that the machines too have to be provided with all the constructional particulars for attaining the desired results and that the atmosphere in which the machines are located has to be appropriately controlled.

To this end, in a widely-used solution the operating organs of the machine, i.e. those which ac on the vial to perform the various operations, are closed within a clamber that is separated from the external environment.

In this chamber, a forced air circulation is set up, from high to low, and is then collected, channeled and returned upwards; the air is then forced to cross suitable filters, located superiorly, which purify the air before directing it newly downwards.

The constant flow of purified air in a downwards direction has the function of confining any polluting particles in the lower part of the machine below the level at which the filling and sealing machines are located, such as to prevent their entering the vial.

In order for the air flow to effectively perform the described function, it must be laminar; this is more or less perturbed by striking against obstacles which due to their shape and/or position generate turbulence in the air flow, i.e. vortices which render the trajectory of any suspended polluting particles uncertain.

Many machines of known type have what is known as a bench conformation, in which all the movement organs (motors. transmissions) and the other secondary components (all the "grey zone") are contained in a sort of box at the base of the machine, while the conveyor line of the vials and the operating organs are located superiorly thereof, connected to the lower movement organs by special transmission means housed in columns, arms and the like.

A machine structure such as the one described above is unsuitable for guaranteeing a non-perturbed laminar flow, due to the fact that the upper horizontal wall of the box (or bench), being perpendicular to the air flow, halts the flow brusquely and thus creates a strong turbulent motion which rises up to the height of the vial filling and closing stations.

SUMMARY OF THE INVENTION

The aim of the present invention is to obviate the drawbacks in the prior art, more precisely by providing a machine for filling vials, the general architecture of which is defined such as not to perturb the laminar flow at the machine operating stations, all of which is obtained by intervening on the form and positioning of the operating organs thereof.

A further aim of the invention relates to the desire to realize the above-described architecture in a way which makes it adaptable to the realization of both machines for open vials and machines for closed vials.

A further aim of the invention consists in providing a machine having compact dimensions and which guarantees high standards of reliability and sturdiness.

The aforementioned aims are obtained by means of a machine for filling vials, comprising: a supply station, including first organs for removing empty open-type vials from a store and arranging the vials in an ordered row at an inlet of a conveyor line; a filling station, positioned along the conveyor line, provided with dispensing means for transferring inside each vial a batched quantity of a liquid product; a closing station, positioned downstream of the filling station, in which means for closing the upper head of the vials operate; an unloading station positioned at an end of the conveyor line, provided with second organs for receiving the vials, full and closed, released by the conveyor line, and for conveying the vials towards an outlet line, the machine comprising a cantilevered bearing structure, to which are associated: a first cantilevered housing box, underlying the supply station; a second cantilevered housing box, having a similar depth to the first cantilevered housing box, underlying the unloading station; a third cantilevered housing box, extending between the first housing box and the second housing box, having a considerably smaller depth than said first housing box and second housing box; a bridge support, extending between the first housing box and the second housing box, externally of the third housing box, for supporting the conveyor line; a fourth housing box, extending between the first housing box and the second housing box, at an external limit thereof, having such a depth that an air passage gap is afforded between the fourth housing box and the third housing box, the air passage gap being substantially vertical and developing in a downwards direction, a width of which is greater than a width of the bridge support; a director extending between the first housing box and the second housing box, located below the air passage, for connecting the air passage with an air outlet, the air outlet being facing external-wise of the machine and positioned considerably below the conveyor line; elements associated to the bearing structure, for defining a chamber in which all aforementioned organs of the machine are contained and separated from an outside environment; forced ventilation means, associated to the chamber, for generating a laminar air flow directed in a downwards direction, a part of which is destined to enter, without turbulence, the air passage, at sides of the conveyor line, and to exit from the air outlet in order to be collected, together with a remaining part of the flow, by means for air channeling associated to an outside of the chamber.

BRIEF DESCRIPTION OF THE DRAWINGS

The characteristics of the invention will emerge from the following description of two preferred embodiments of the machine, respectively for open vials and closed vials, in accordance with the contents of the claims and with the aid of the accompanying figures of the drawings, in which:

Figure 1:
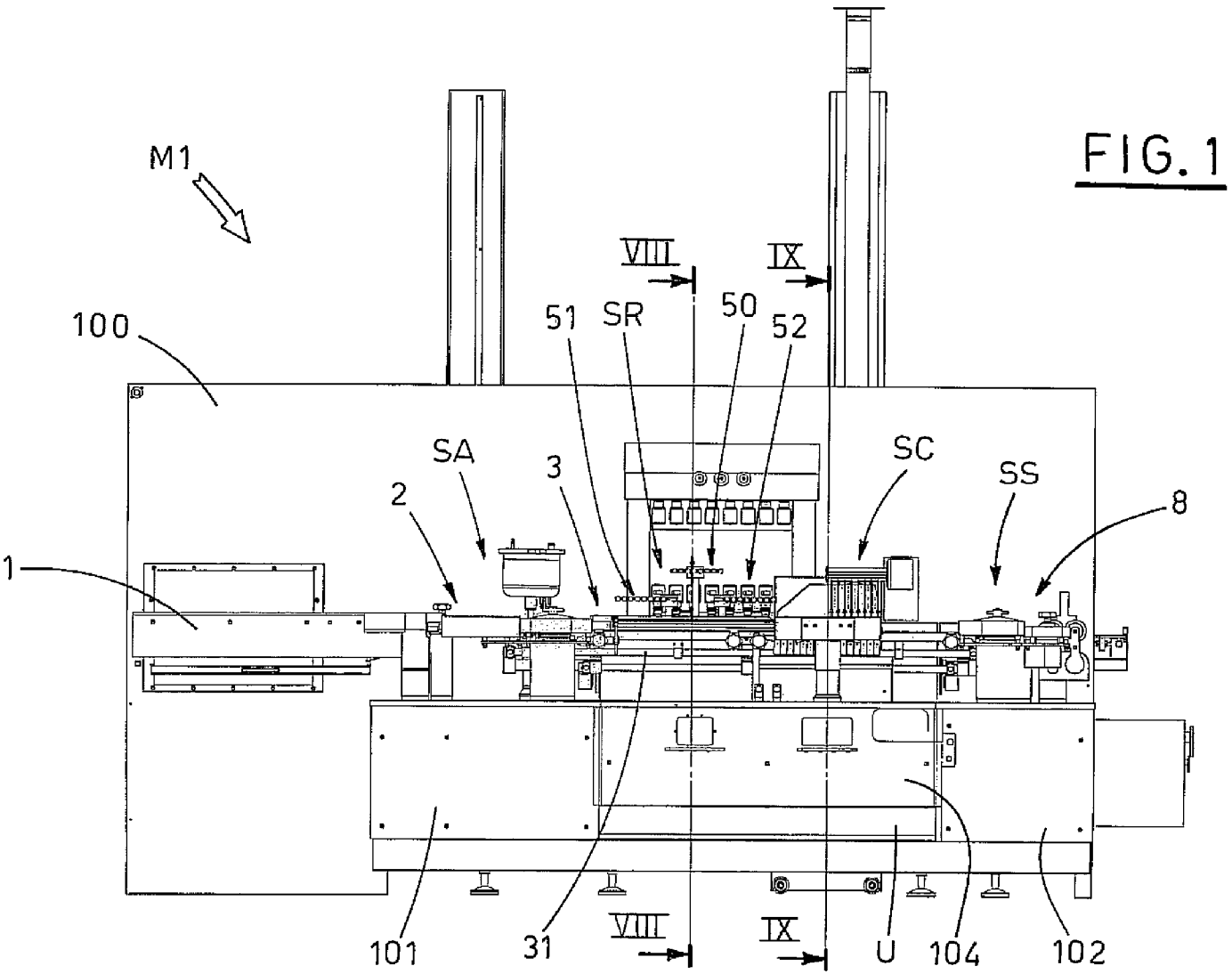
FIG. 1 illustrates a front view of the machine, in a first embodiment for open vials.
Figure 2:
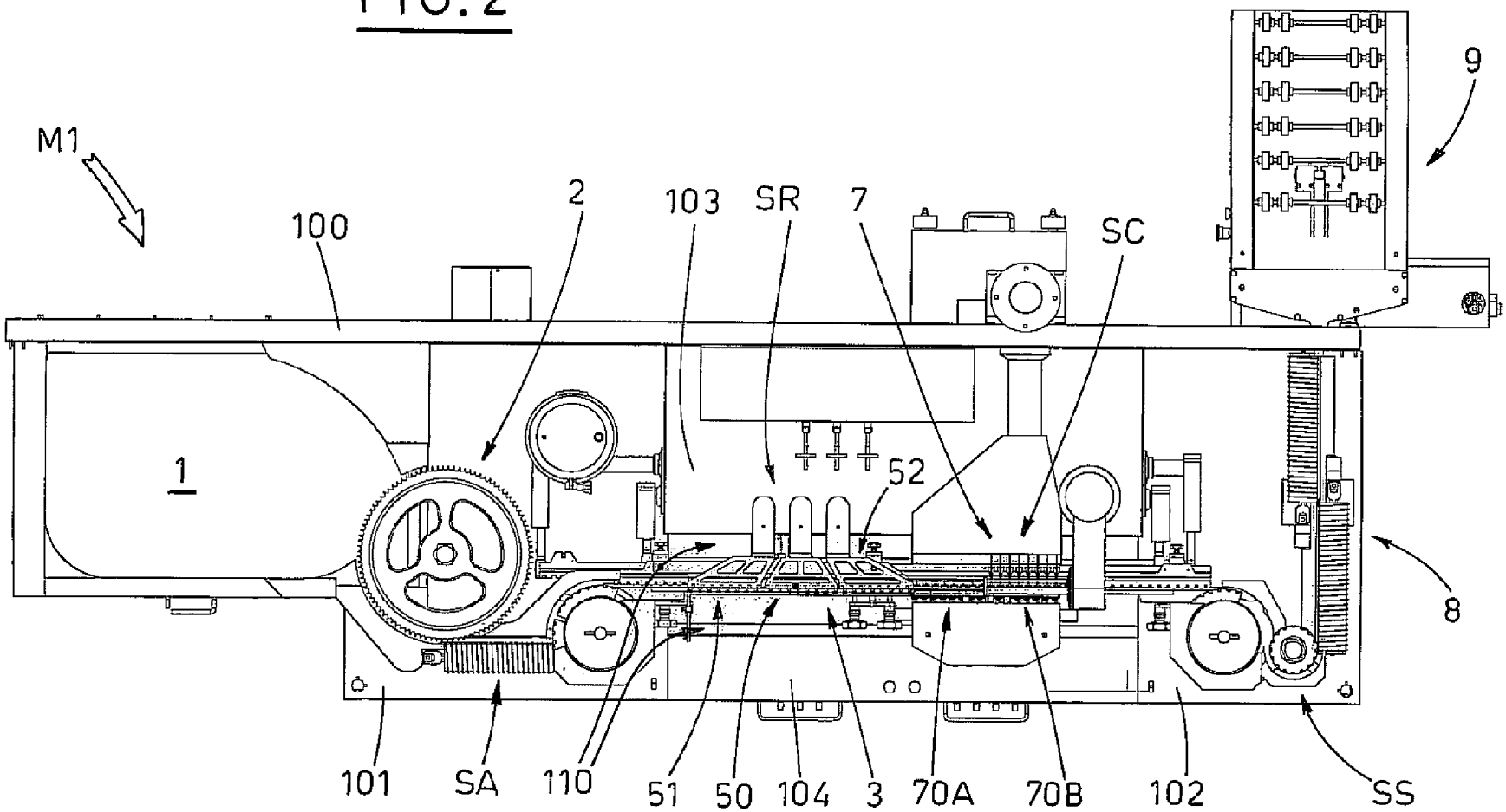
FIG. 2 illustrates a plan view of the machine of FIG. 1.
Figure 3:
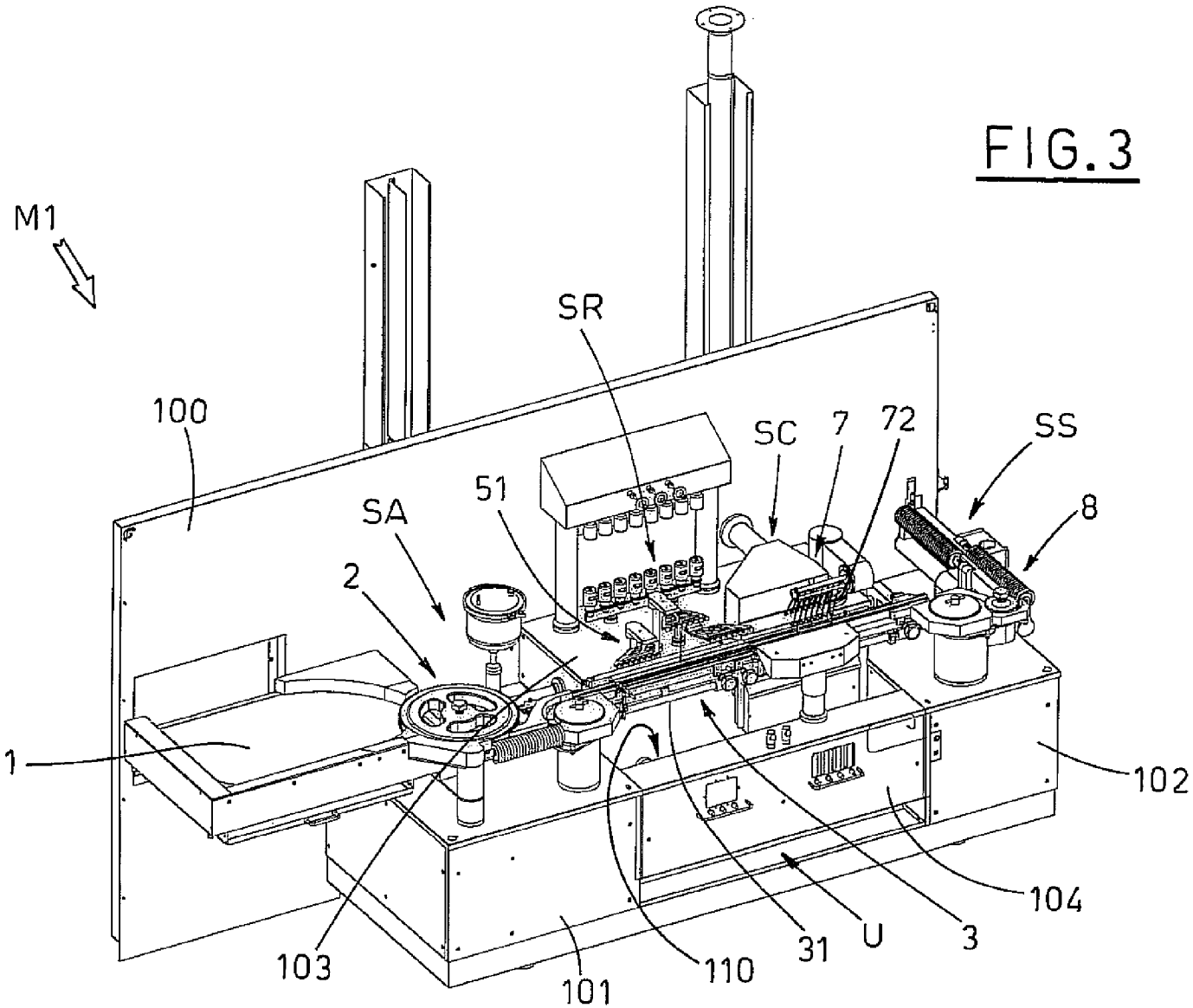
FIG. 3 is a perspective view of the machine of FIG. 1.
Figure 4:
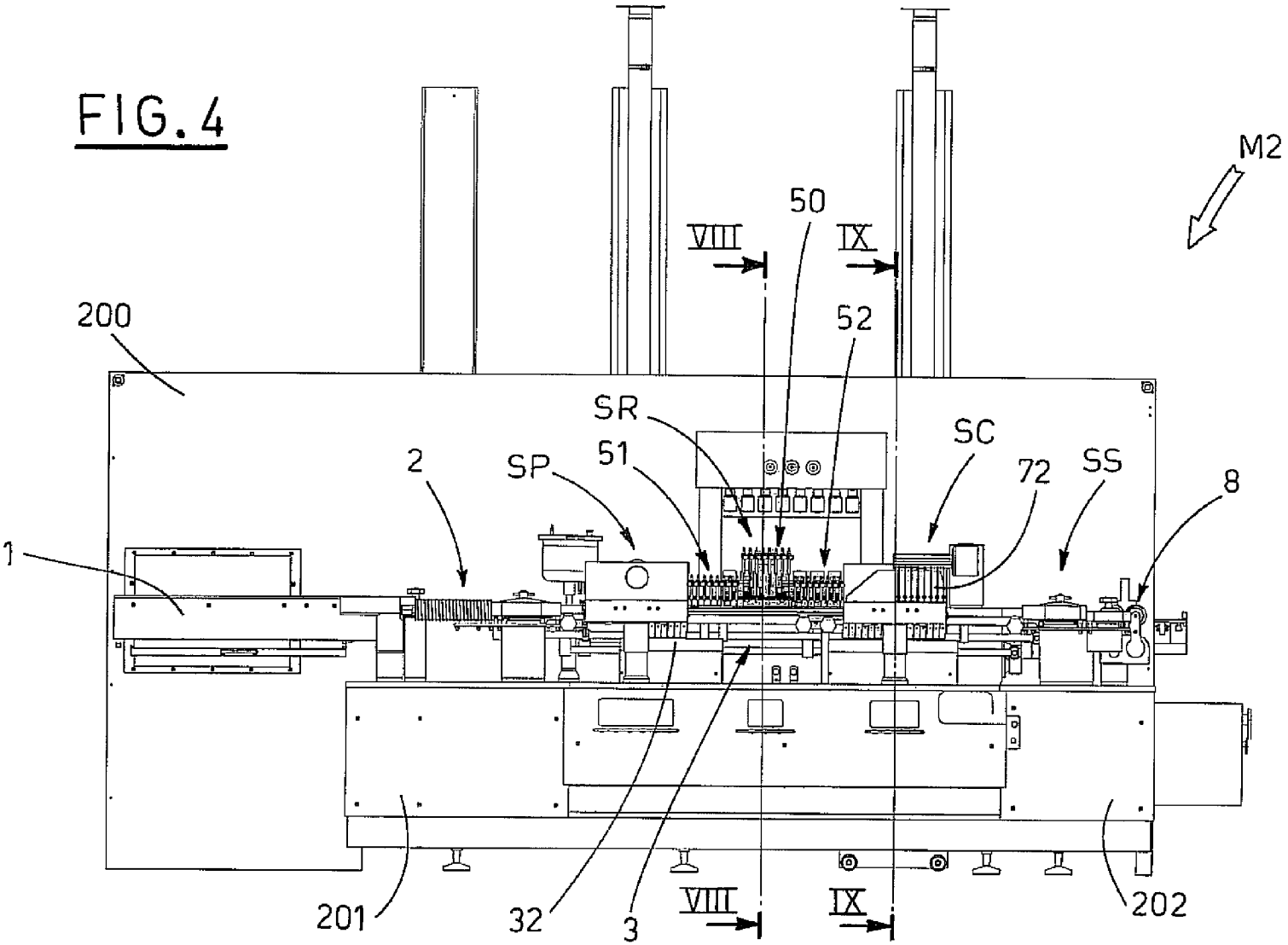
FIG. 4 is a front view of the machine in a second embodiment for closed vials.
Figure 5:
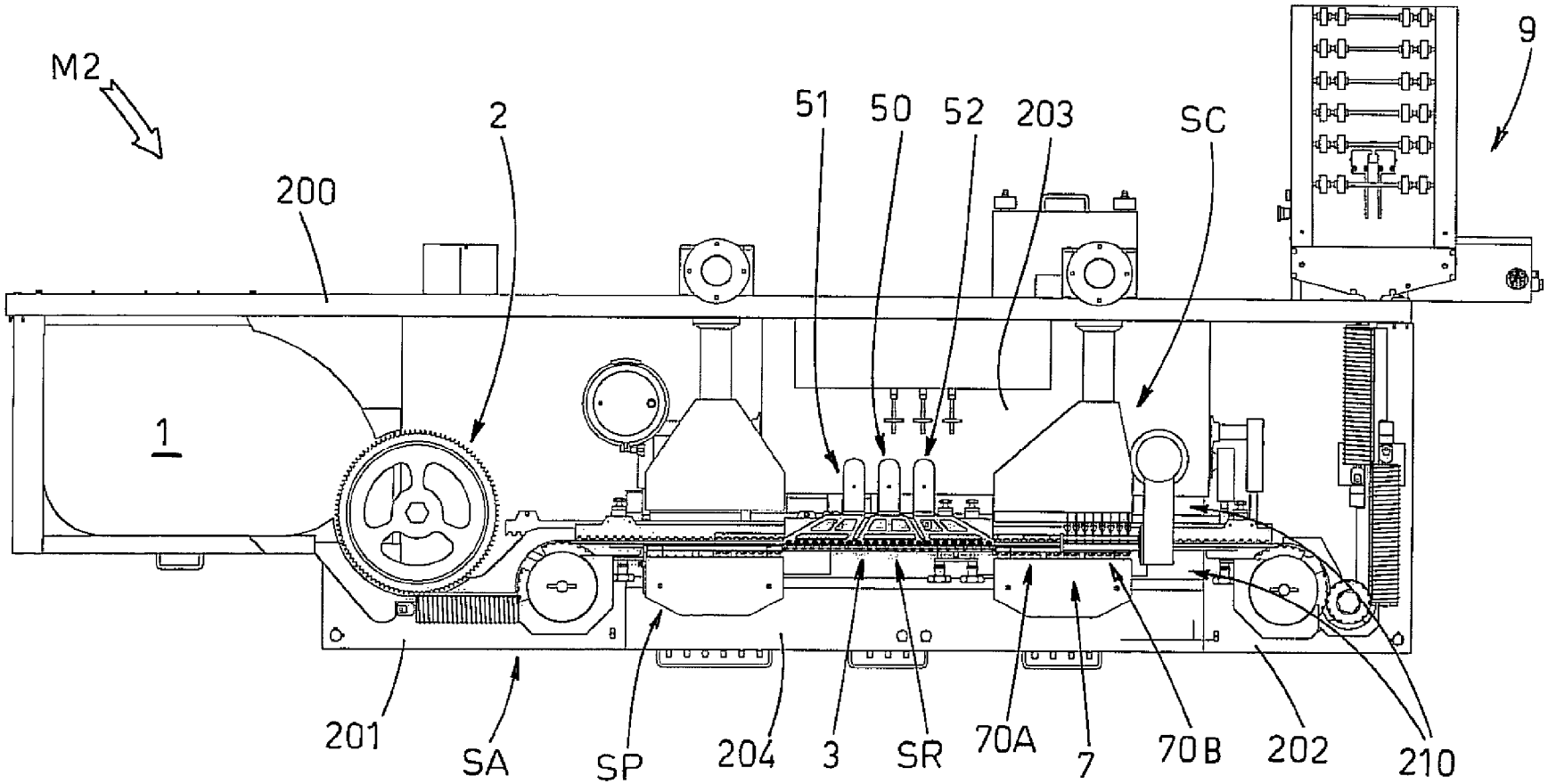
FIG. 5 is a plan view of the machine of FIG. 4.
Figure 6:
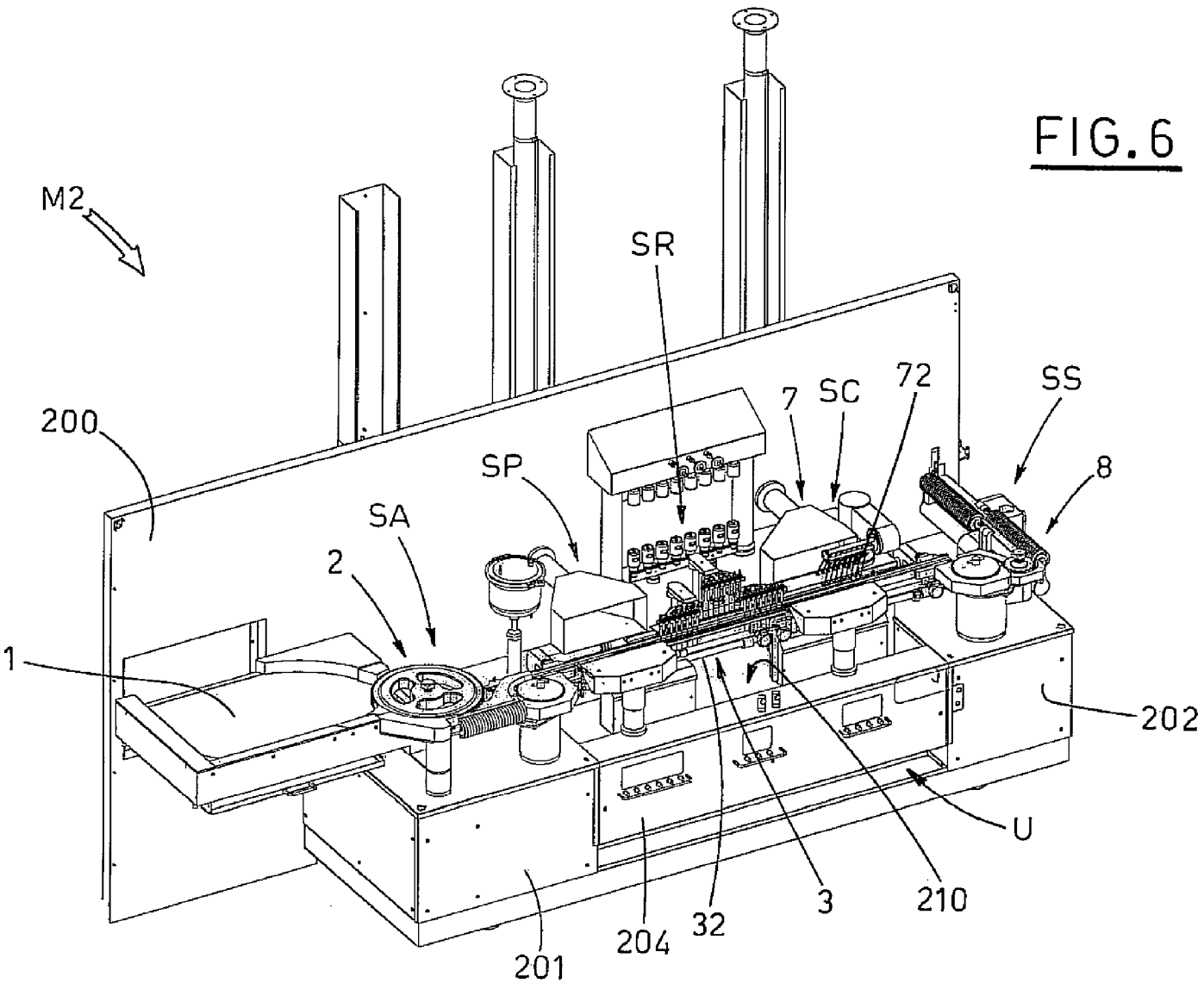
FIG. 6 is a first perspective view of the machine of FIG. 4, from the vial inlet side.
Figure 7:
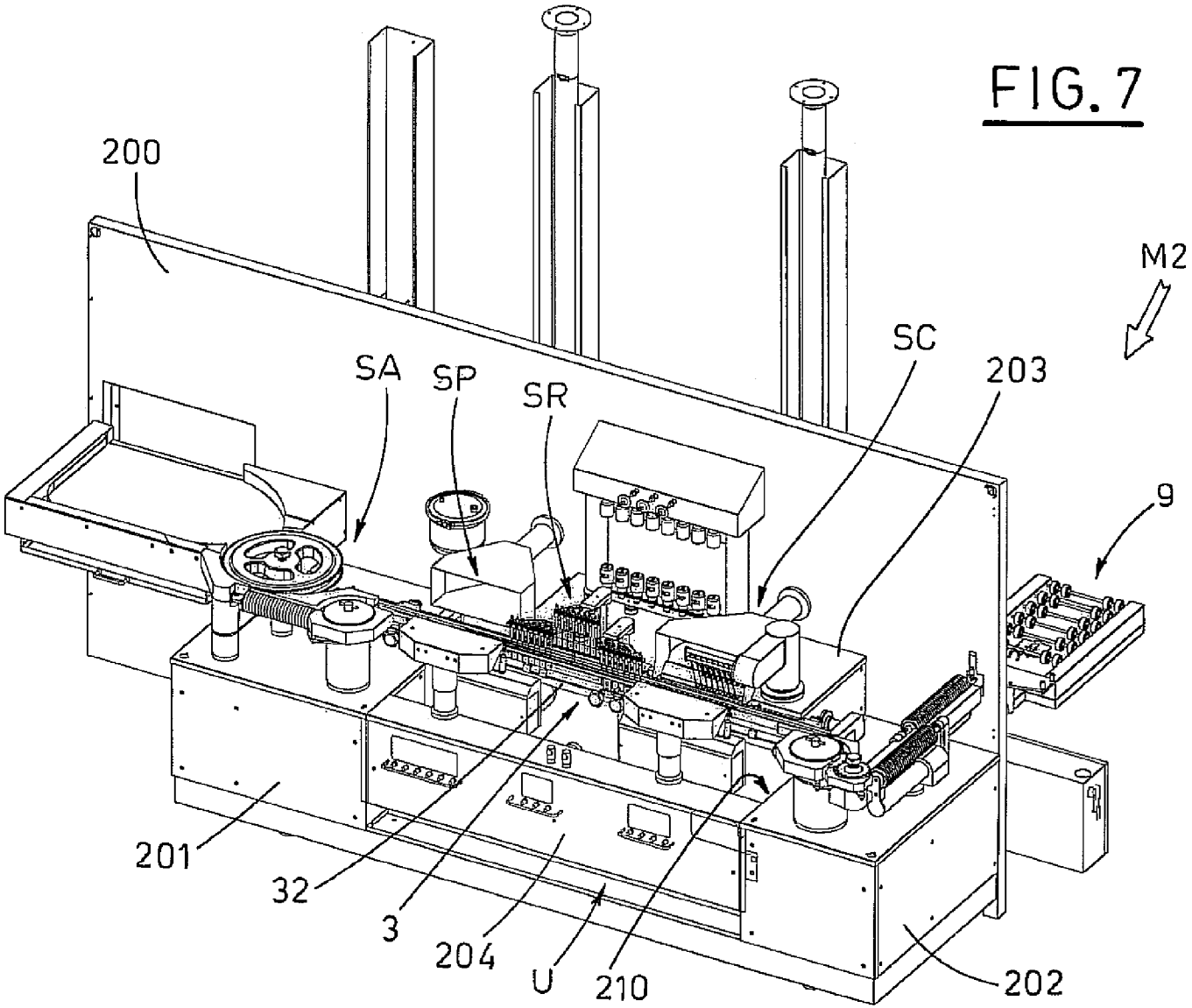
FIG. 7 is a second perspective view of the machine of FIG. 4, from the vial outlet side.
Figure 10A:
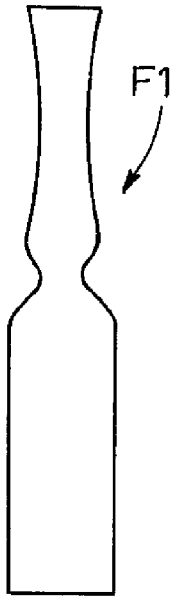
FIG. 10A illustrates an open vial.
Figure 10B:
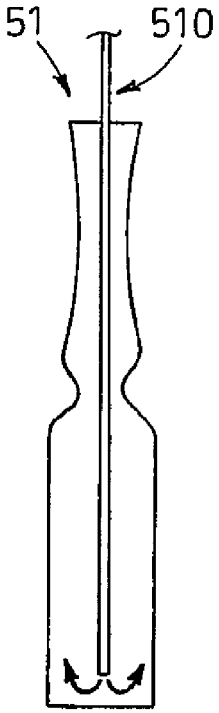
Figure 11A:
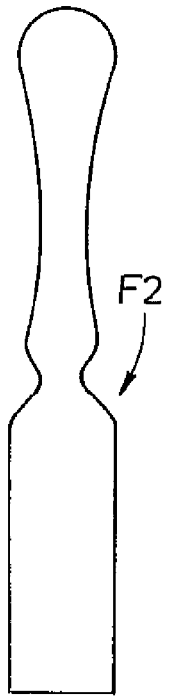
Figure 12:
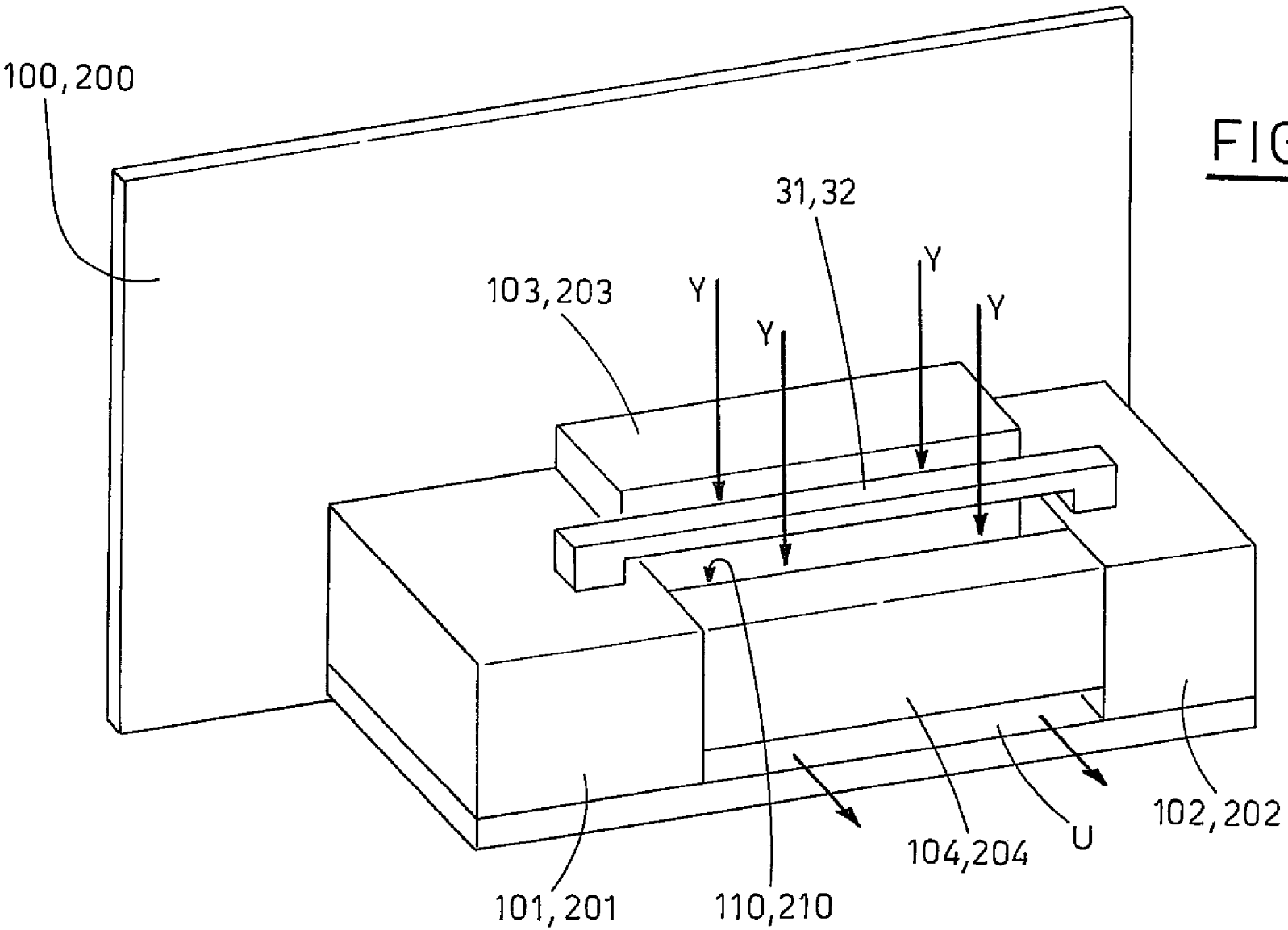

figures from 10B to 10G schematically illustrate the various operating stages actuated by the machine of FIG. 1 on the vial of FIG. 10A;

FIG. 11A illustrates a closed vial;

figures from 11B to 11H schematically illustrate the various operating stages performed by the machine of FIG. 4 on the vial of FIG. 11A;

FIG. 12 illustrates, in a schematic perspective view, the general architecture of the machines in the two indicated embodiments.

DESCRIPTION OF THE PREFERRED EMBODIMENTS

With reference to the figures from 1 to 3, M1 denotes a first embodiment of the machine of the invention, suitable for open vials F1 (FIG. 10A) as mentioned in the preamble hereto.

With reference to figures from 4 to 7, M2 denotes a second embodiment of the machine of the invention, suitable for closed vials F2, also as mentioned in the premises.

Figure 10C:
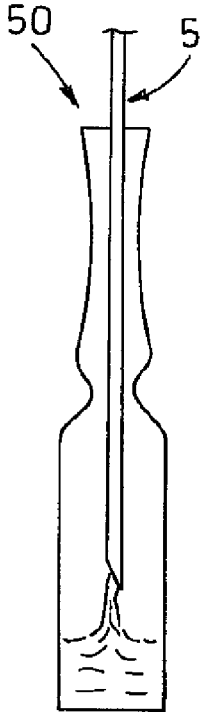
Figure 10D:
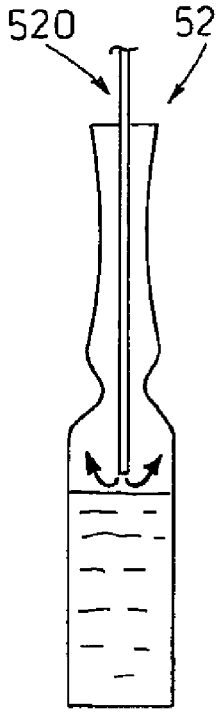
Figure 10E:
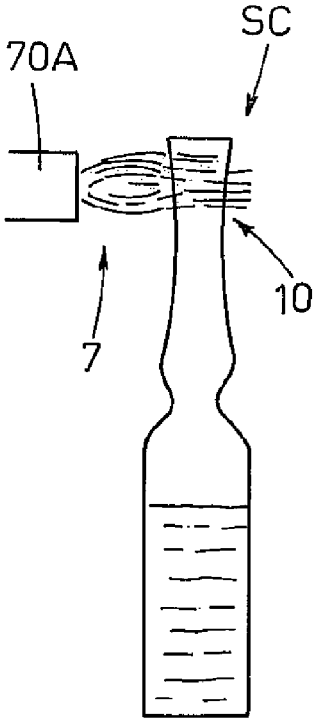
Figure 10F:
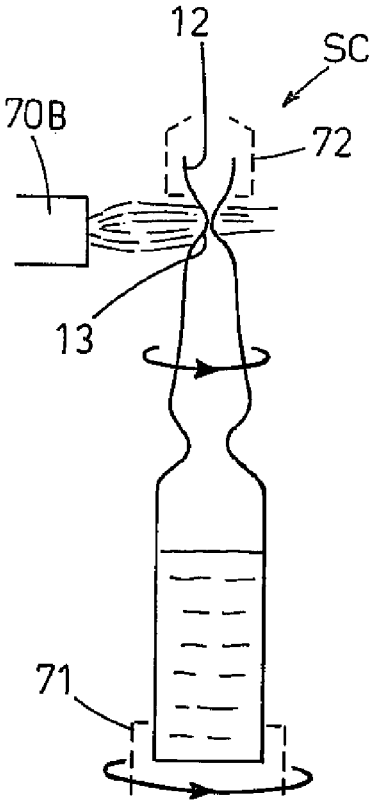
Figure 10G:
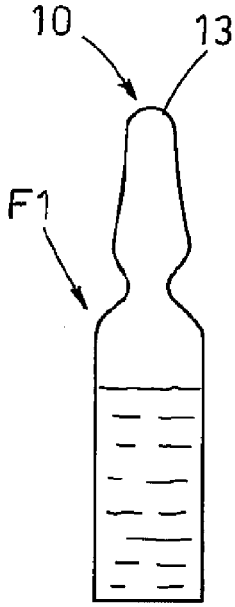

The known machines M1, M2 comprise:

a supply station SA comprising first organs 2 which collect the empty vials F1, F2 from a store 1 and place them in an ordered line at an inlet of a conveyor line 3;

a filling station SR, positioned along the conveyor line 3, comprising at least a filling section 50 in which dispensing means 5 are included, which dispensing means 5 are destined to place, in each vial F1, F2, a batched quantity of the liquid product; the dispensing means 5 comprise nozzles which insert in corresponding vials F1, F2 (see FIGS. 10C and 11D); in the accompanying figures the filling station SR further comprises two auxiliary sections 51, 52, positioned respectively upstream and downstream of the filling section 50, in which corresponding nozzles 510, 520 are comprised which will insert in the vials F1, F2 in order blow inert gas there-into, for example nitrogen, with which the air will be replaced, preventing oxidation of the liquid product (see FIGS. 10B, 10D and 11C, 11E);

a closing station SC, positioned downstream of the filling station SR, in which means 7 act to close the upper head 10, 20 of the vials F1, F2; the closing station SC is constituted by a pre-heating section and by a following sealing station, in which the means 7 comprise corresponding specially-oriented first and second tubes 70A, 70B, each of which is destined to send a flame to strike a predetermined zone of the upper head 10, 20; the sealing section also comprises chucks 71 which set the vials F1, F2 in rotation, and plier means 72 for removing the exceeding portion 12, 22 above the closing bulb 13, 23 which is formed in the upper head 10, 20 (see FIGS. 10E, 10F and 11F, 11G);

an unloading station SS, positioned at the end of the conveyor line 3, provided with second organs 8 for receiving the closed vials F1, F2 with the liquid product inside (FIGS. 10G, 11H), released by the line 3, and convey them towards an outlet line.

Figure 11B:
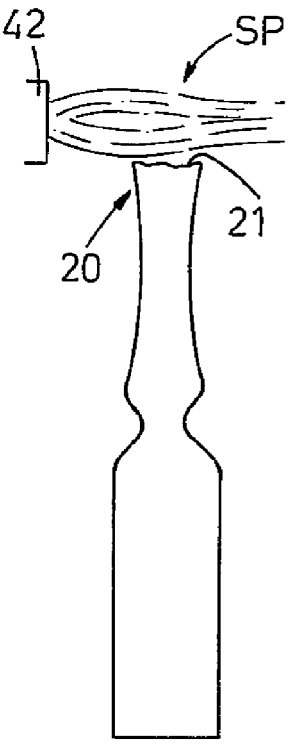
Figure 11C:
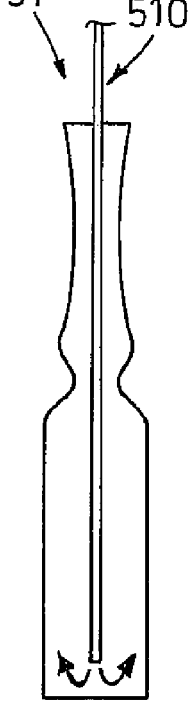
Figure 11D:
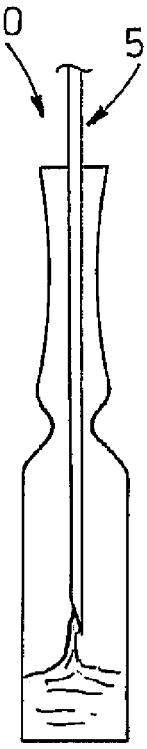
Figure 11E:
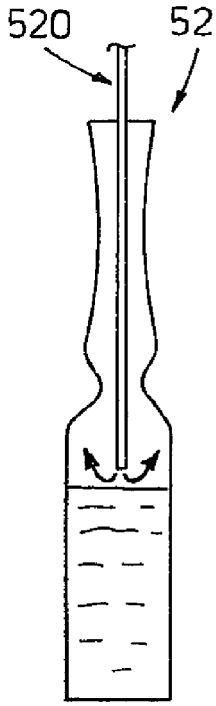
Figure 11F:
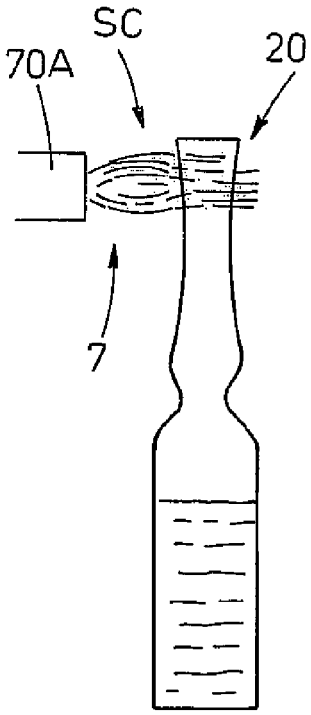
Figure 11G:
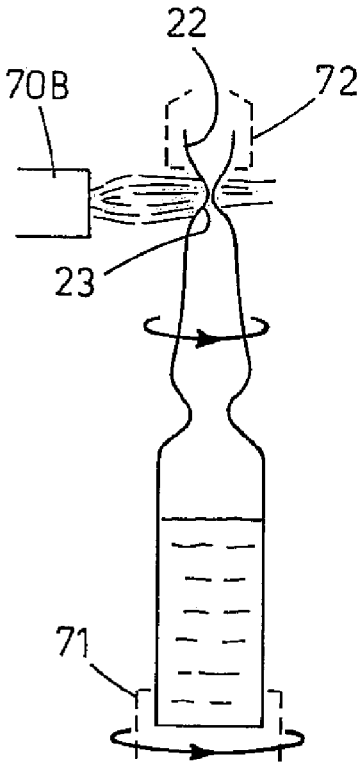
Figure 11H:
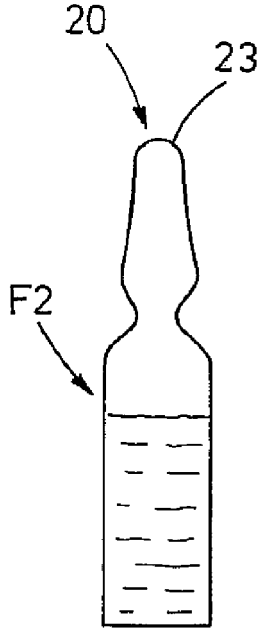

In the machine M2 of the second embodiment, between the supply station SA and the filling station SR there is a preparation station SP in which the upper head 20 of the closed vials F2 is opened, in order that the dispensing means 5 of the following filling station SR can issue the liquid product into the vials; for the above-indicated operation specially-oriented tubes 42 are provided, each of which sends a flame to strike a corresponding upper head 20 for a sufficient time to cause the local melting of the glass; this aspect, in combination with the rotation of the vial about the axis thereof, leads to definition of an upper opening 21 (see also FIG. 11B).

The configurations of the machines M1, M2 illustrated and described are examples and are obviously not limiting: in variants which are not illustrated herein, suitable for certain types of working, the auxiliary sections 51, 52 for blowing the nitrogen could be one in number, or could even be absent.

In the invention, the machines M1, M2 include a respective cantilever bearing structure 100, 200, which is substantially identical in both machines, except for the longitudinal development, which is greater in the structure denoted by 200.

The following are associated to the structure 100, 200:

a first cantilevered housing box 101, 201, underlying the supply station SA and destined to contain movement organs, not illustrated, for activating the first organs 2;

a second cantilevered housing box 102, 202 having a similar depth to the first cantilevered housing box 101, underlying the unloading station SS and destined to contain movement organs, not illustrated, for activating the second organs 8;

a third cantilevered housing box 103, 203 extending between the first housing box 101, 201 and the second housing box 102, 202 having a considerably smaller depth than said first housing box 101, 201 and second housing box 102, 202 and destined to contain movement organs, not illustrated, for activating a part of the operating organs of the filling station SR and closing station SC; in the machine M2 for closed vials, the respective third box 203 further contains at least a part of the activating organs of the operating organs in the above-described preparation station SP;

a bridge support 31, 32 extending between the first housing box 101, 201 and the second housing box 102, 202, externally of the third housing box 103, 203, for supporting the conveyor line 3 and for housing organs, not illustrated, which act in phase relation with the conveyor line 3;

a fourth housing box 104, 204, extending between the first housing box 101, 201 and the second housing box 102, 202, at an external limit thereof, having such a depth that an air passage gap 110, 210 is afforded between the fourth housing box 104, 204 and the third housing box 103, 203, the air passage gap 110, 210 being substantially vertical and developing in a downwards direction, a width of which is greater than a width of the bridge support 31, 32; further movement organs (not illustrated) being contained in the fourth housing box 104, 204, for activating a remaining part of the operating organs of the filling station Sr and the closing station SC; in the machine M2 for closed vials, the fourth housing box 204 further contains the remaining part of the activating organs of the operating organs present in the preparation station SP;

a director 120, 220 extending between the first housing box 101, 201 and the second housing box 102, 202, located below the air passage 110, 210, for connecting the air passage 110, 210 with an air outlet U, the air outlet U facing externalwise of the machine M1, M2 and positioned considerably below the conveyor line (3).

Figure 8:
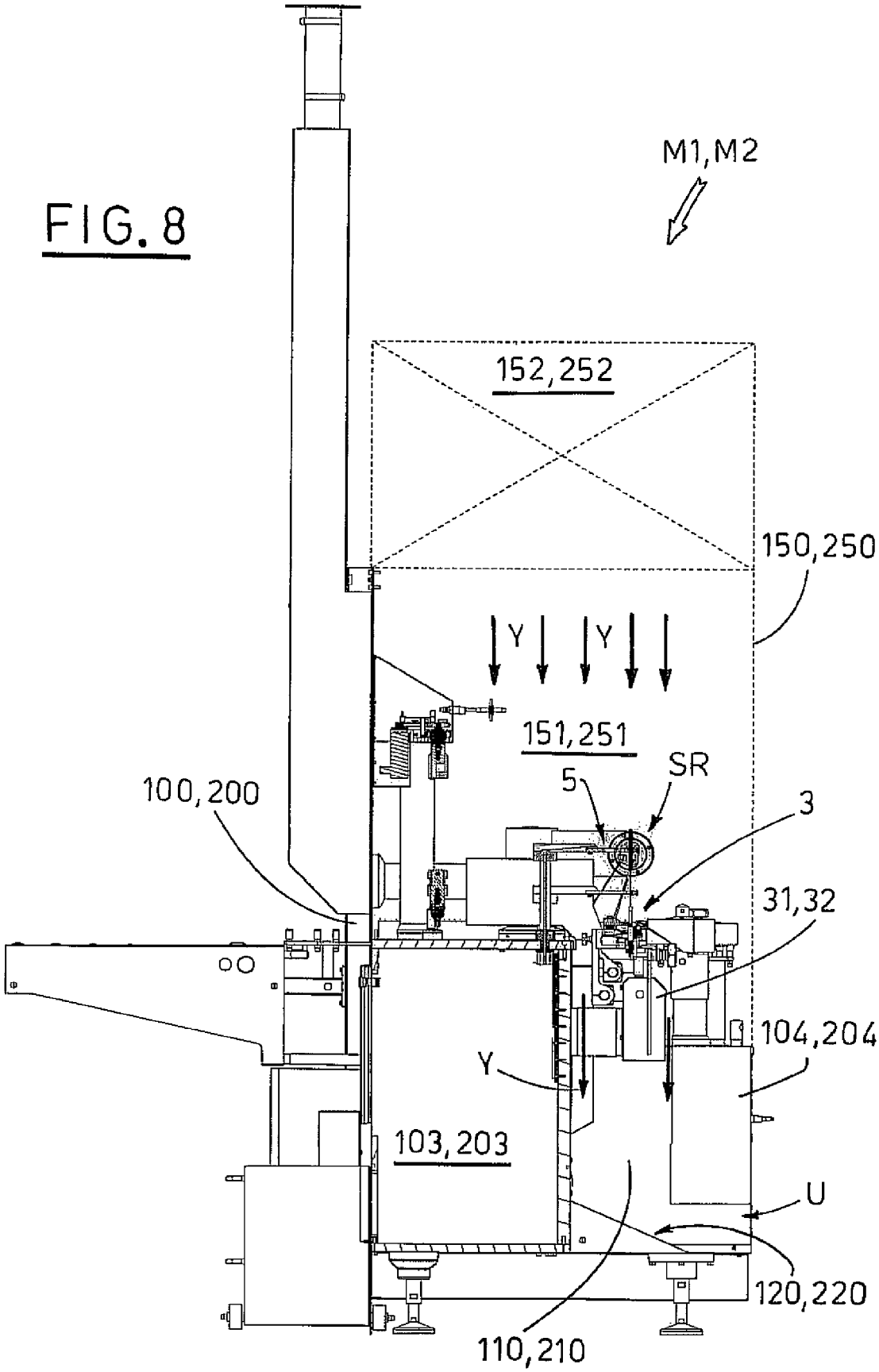
FIG. 8 is first identical section of the machine of FIG. 1 and FIG. 4, along respective planes VIII-VIII.
Figure 9:
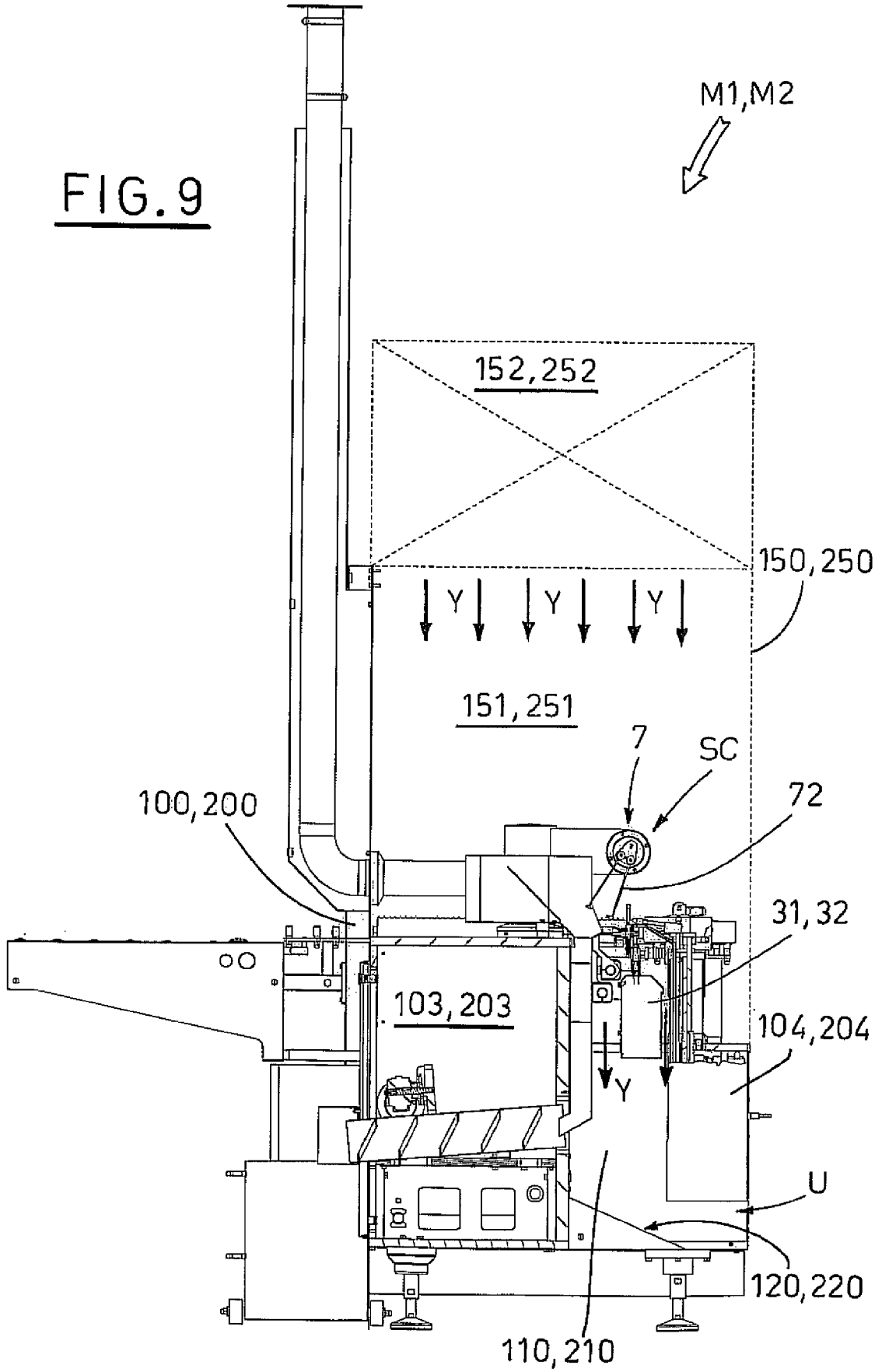
FIG. 9 is a second identical section of the machine of FIG. 1 and FIG. 4, along respective planes IX-IX.

Further associated to the cantilever bearing structure 100, 200 are panels 150, 250, for example glass panes, denoted schematically with dotted lines in FIGS. 8, 9, which define a chamber 151, 251 in which the above-listed elements are contained and separated from the external environment.

Alternatively, the chamber 151, 251 can be defined by masonry erections (not illustrated) associated to the cantilever bearing structure 100, 200.

Forced ventilation means (not illustrated) are associated to the chamber 151, 251 which generate a laminar air flow directed from above towards below (arrows Y in FIGS. 8, 9), a quantity of which is destined to enter, without perturbation, the air passage gap 110, 210, at the sides of the conveyor line 3, and to exit from the air outlet U to be collected, together with the remaining part of the flow, by air channeling means (not illustrated) associated to the outside of the chamber 151, 251.

Worthy of note is the fact that the conveyor line 3 is activated by a comb-like device which is realized in such a way as to have only a minimum effect on the air flow produced by the laminar flow; this is due to the special conformation of the comb, which frees the air passage gap 110, 210.

The channeling means bring the air upwards, where it is forced to cross special filters 152, 252 located above the chamber 151, 251 and schematically denoted in a broken line in FIGS. 8 and 9, which purify the air before re-directing it downwards.

The conformation of the above-described machine M1, M2 is advantageous in preventing the onset of turbulence in the air flow, in particular in the zones at the sides of the conveyor line 3, along which the filling station SR and the closing station SC are located.

The contemporary presence of the bridge support 21, 32 and the underlying air passage gap 110, 210, extending downwards and connected to the director 120, 220, enables a regular laminar flow by the side of the vials F1, F2 arranged along the conveyor line 3, thus preventing any polluting particles from accidentally entering the vials F1, F2; in the machines M2 for closed vials, the relative preparation station SP is also crossed by the laminar air flow which the enters the air passage gap 210.

From the above description it is clear how the general architecture as herein defined in perfectly adaptable to machines MI for open vials F1 and to machines M2 for closed vials F2 (see in particular FIG. 12), which in all cases are of compact dimensions and ergonomically advantageous for operations of visual control and/or maintenance by operators.

The architecture of the described machines enables high levels of reliability and sturdiness to be maintained, which are without doubt comparable to those of known machines.

The above however is intended as an example and is therefore non-limiting; any modifications in details which might become necessary for technical and/or functional reasons are considered to fall within the ambit of protection as defined in the following claims.

What is claimed:

1. A machine for filling vials, comprising:

a conveyor line for conveying the vials;

a supply station, including first organs for removing empty open-type vials from a store and arranging the vials in an ordered row at an inlet of the conveyor line;

a filling station, positioned along the conveyor line, provided with dispensing means for transferring a batched quantity of a liquid product into each vial;

a closing station, positioned downstream of the filling station, having means for closing an upper head of the liquid product containing vials;

an unloading station positioned at an end of the conveyor line, provided with second organs for receiving the liquid product filled and closed vials, released by the conveyor line, and for conveying the filled and closed vials towards an outlet line;

a cantilevered bearing structure, situated laterally relative to and along the conveyor line;

a first cantilevered housing box, cantilever mounted to the cantilevered bearing structure, supporting the supply station;

a second cantilevered housing box, cantilever mounted to the cantilevered bearing structure, supporting the unloading station and having a depth similar to a depth of the first cantilevered housing box;

a third cantilevered housing box, cantilever mounted to the cantilevered bearing structure between the first cantilevered housing box and the second cantilevered housing box, the third cantilevered housing box, extending between the first housing box and the second housing box, having a depth smaller than the depths of said first housing box and second housing box, the third cantilevered housing box supporting the filling station and the closing station;

a bridge support, extending from above the first housing box to above the second housing box, externally of the third housing box, for supporting the conveyor line;

a fourth housing box, extending between the first housing box and the second housing box, at an external limit thereof, having such a depth that a gap is provided between the fourth housing box and the third housing box, the gap having a width greater than a width of the bridge support so that air passages are defined at both sides of the conveyor line supported by the bridge support, the air passages being substantially vertical and developing in a downwards direction;

elements connected to the bearing structure defining a chamber which surrounds and separates the conveyor line, supply station, filling station, the closing station, the unloading station and the first through fourth cantilevered housing boxes contained therein from an outside environment;

forced ventilation means for generating a laminar air flow directed in a downwards direction through the chamber, a part of the laminar air flow passing downwardly and unobstructedly through the air passages so as to avoid turbulence and maintain a laminar air flow passing by the conveyor line supported by the bridge support;

a director extending between the first housing box and the second housing box, located in the gap below the air passages, for directing the part of the laminar air flow passing through the air passages located at the sides of the conveyor line to an air outlet facing externally in relation to the chamber and positioned below the conveyor line;

the laminar air flow exiting from the air outlet in to an outside of the chamber.

2. The machine of claim 1, wherein said elements are constituted by panels.

3. The machine of claim 1, wherein said elements are constituted by wall structures.

4. A machine for filling vials, comprising:

a conveyor line for conveying the vials;

a supply station, including first organs for removing empty open-type vials having closed upper heads from a store and arranging the vials in an ordered row at an inlet of the conveyor line;

a preparation station, positioned along the conveyor line, having means for opening the upper heads of the closed vials, for opening the vials;

a filling station, positioned along the conveyor line, provided with dispensing means for transferring a batched quantity of a liquid product into each vial;

a closing station, positioned downstream of the filling station, having means for closing the upper head of the liquid product containing vials;

an unloading station positioned at an end of the conveyor line, provided with second organs for receiving the liquid product filled and closed vials, released by the conveyor line, and for conveying the filled and closed vials towards an outlet line;

a cantilevered bearing structure, situated laterally relative to and along the conveyor line;

a first cantilevered housing box, cantilever mounted to the cantilevered bearing structure, supporting the supply station;

a second cantilevered housing box, cantilever mounted to the cantilevered bearing structure, supporting the unloading station and having a depth similar to a depth of the first cantilevered housing box;

a third cantilevered housing box, cantilever mounted to the cantilevered bearing structure between the first cantilevered housing box and the second cantilevered housing box, the third cantilevered housing box, extending between the first housing box and the second housing box, having a depth smaller than the depths of said first housing box and second housing box, the third cantilevered housing box supporting the preparation station, the filling station and the closing station;

a bridge support, extending from above the first housing box to above the second housing box, externally of the third housing box, for supporting the conveyor line;

a fourth housing box, extending between the first housing box and the second housing box, at an external limit thereof, having such a depth that a gap is provided between the fourth housing box and the third housing box, the gap having a width greater than a width of the bridge support so that air passages are defined at both sides of the conveyor line supported by the bridge support, the air passages being substantially vertical and developing in a downwards direction;

elements connected to the bearing structure defining a chamber which surrounds and separates the conveyor line, the supply station, the preparation station, the filling station, the closing station, the unloading station and the first through fourth cantilever housing boxes contained therein from an outside environment;

forced ventilation means for generating a laminar air flow directed in a downwards direction through the chamber, a part of the laminar air flow passing downwardly and unobstructedly through the air passages so as to avoid turbulence and maintain a laminar air flow passing by the conveyor line;

a director extending between the first housing box and the second housing box, located in the gap below the air passages, for directing the part of the laminar air flow passing through the air passages located at the sides of the conveyor line to an air outlet facing externally in relation to the chamber and positioned below the conveyor line;

the laminar air flow exiting from the air outlet to an outside of the chamber.

5. The machine of claim 4, wherein said elements are constituted by panels.

6. The machine of claim 4, wherein said elements are constituted by wall structures.

* * * * *